US005339848A

United States Patent [19]

Richmond

[11] Patent Number: 5,339,848

[45] Date of Patent: Aug. 23, 1994

[54] MOTORIZED SUNSHADE

[76] Inventor: Henry Richmond, The Crossing At Blindbrook, Purchase, N.Y. 10577

[21] Appl. No.: 181,327

[22] Filed: Jan. 18, 1994

[51] Int. Cl.[5] ..... A45B 11/00

[52] U.S. Cl. ..... 135/20.1; 135/33.7; 136/246

[58] Field of Search ..... 135/16, 19.5, 20.1, 135/20.3, 74, 33.7, 91; 136/246, 291; 353/3; 250/203.4; 323/906

[56] References Cited

U.S. PATENT DOCUMENTS

| | | | |
|---|---|---|---|
| 1,378,904 | 5/1921 | Schuermann . | |
| 1,567,740 | 12/1925 | Lavagetto . | |
| 2,023,155 | 12/1935 | Turner . | |
| 2,546,099 | 3/1951 | Jamison et al. | 135/33.7 X |
| 2,615,459 | 10/1952 | Adams . | |
| 2,653,050 | 9/1953 | Ashcraft . | |
| 2,685,353 | 8/1954 | Caskie | 135/114 X |
| 3,867,019 | 2/1975 | Eyerman . | |
| 4,276,872 | 7/1981 | Blake et al. | 250/203.4 X |
| 4,601,282 | 7/1986 | Mountain | 250/203.4 X |
| 4,836,231 | 6/1989 | Peterson . | |
| 4,878,509 | 11/1989 | Tung . | |
| 4,922,088 | 5/1990 | Kasuya | 250/203.4 |
| 5,012,852 | 5/1991 | Blackhurst . | |
| 5,033,528 | 7/1991 | Volcani . | |

FOREIGN PATENT DOCUMENTS

| | | | |
|---|---|---|---|
| 532639 | 2/1958 | Belgium | 135/20.1 |
| 565535 | 7/1960 | Belgium | 135/20.1 |

*Primary Examiner*—Carl D. Friedman
*Assistant Examiner*—Lan C. Mai
*Attorney, Agent, or Firm*—Sprung, Horn, Kramer & Woods

[57] ABSTRACT

A sunshade for providing protection from the sun has an upright support member and a sunshield pivotally mounted to the support member for movement between two angular positions. The sunshield is incrementally moved by a motor between the two angular positions to dispose the sunshield in desired position relative to the position of the sun.

26 Claims, 4 Drawing Sheets

MOTORIZED SUNSHADE

BACKGROUND OF THE INVENTION

The present invention relates to a sunshade and in particular to a motorized sunshade which adjusts its position to a desired one relative to the position of the sun .

While sunshades, such as umbrellas and the like are known which are capable of having their position manually adjusted, these sunshades are maintained in a fixed position until they are manually readjusted.

SUMMARY OF THE INVENTION

The main object of the present invention is to eliminate the disadvantages of the prior art and provide a sunshade which is capable of automatically adjusting its position to the position of the sun.

These and other objects and advantages of the present invention are achieved in accordance with the present invention by a sunshade and a method for providing protection from the sun.

In accordance with the invention, an upright support member has a sunshield or shade pivotally mounted thereto for movement between a first angular position and a second angular position. An energizable means incrementally moves the sunshield between the first and second angular positions to gradually move the sunshield to dispose it in a desired position relative to the position of the sun.

The sunshield preferably comprises a semicircular member having an arcuate edge and a straight edge and wherein the arcuate edge is pivotally connected to the support member which is preferably an upright pole. The pole is preferably removably mounted in the ground in a sleeve which is buried in the ground or cemented into place.

The sunshield is preferably made of a rigid lightweight material such as fiberglass or aluminum. The sunshield is moved by a step or continuous motion motor which has a rotatable power shaft and a transmission connects the shaft to the sunshield to pivot or slant the sunshield in response to the rotation of the shaft. The step motor is incrementally rotated by use of a timer which periodically energizes the motor and effects a gradual movement of the sunshield between the first and second positions.

In a preferred embodiment, the motor is energized by a battery or AC current. In a more preferred embodiment, the motor is energized by photovoltaic cells on one or both sides of the sunshield.

The sunshield is preferably hingedly connected to the pole and the sunshield can be adjusted in its width by providing a hollow main body and two side members slidably received in the hollow main body for movement toward and away from each other to achieve the width adjustment.

In an alternative embodiment, the sunshield is hingedly mounted on a sleeve on the pole so that the entire assembly can be lowered to the ground when not in use or if there are strong winds.

In another embodiment, in order to diminish the effect of wind, the sunshield has front and rear surfaces which have out of phase slots therealong which allow the wind to pass without allowing light to pass to any significant extent.

In accordance with the method of the present invention, a sunshield which is pivotally mounted to a support is incrementally moved between first and second angular positions.

These and other features and advantages of the present invention will be discussed in more detail within the following detailed description taken with the attached drawings, wherein:

DETAILED DESCRIPTION OF THE INVENTION

Figure 1:
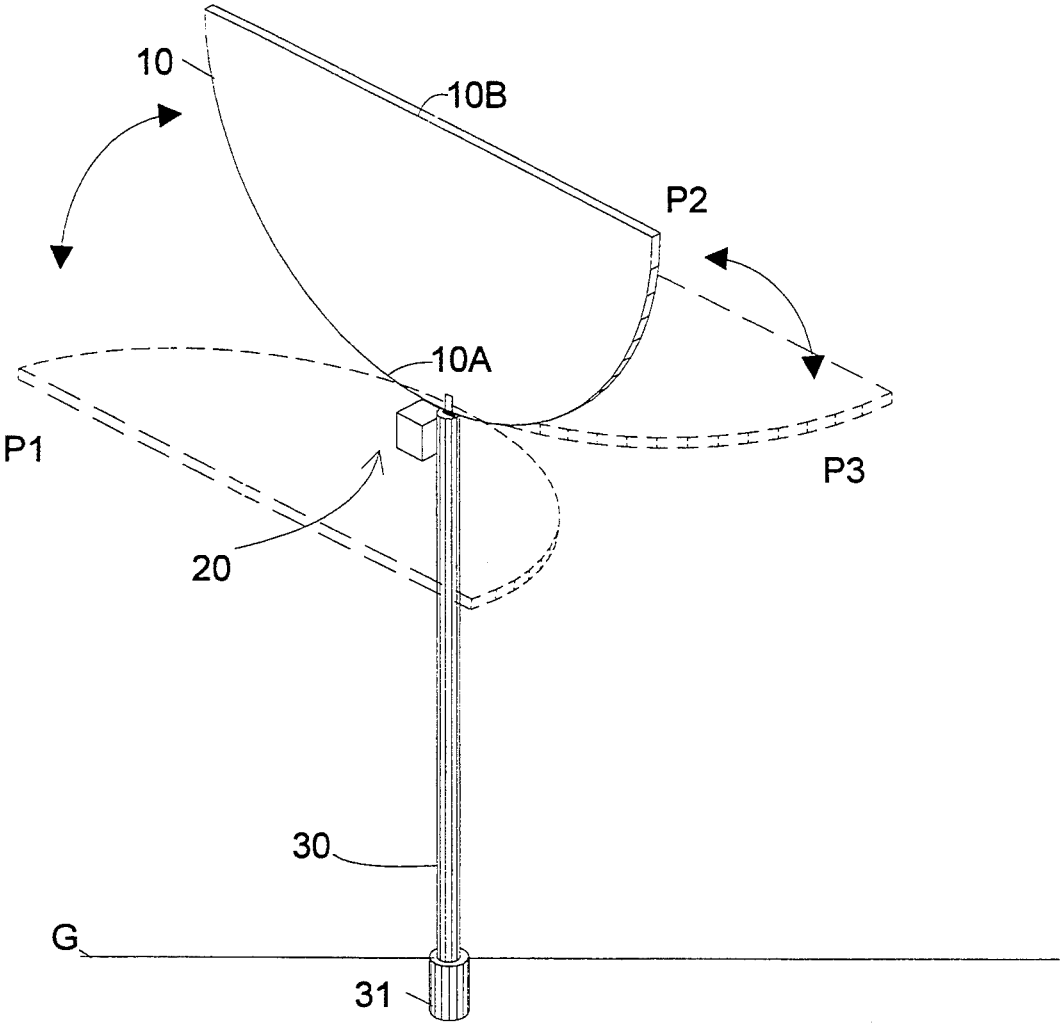
FIG. 1 is a perspective view of a sunshade according to the present invention.

Referring now to FIG. 1, the sunshade according to the present invention comprises an upright support member including pole 30 mounted in a sleeve 31 which is buried below grade G. Pivotally mounted to the pole 30 is a sunshield 10 having a semicircular configuration with the arcuate edge 10A adjacent the pole 30 and its straight edge 10B disposed away from the pole.

A transmission 20 moves the sunshield 10 between a first angular position P1 and a second angular position P3. Angular position P2 is an intermediate position between positions P1 and P3.

In a preferred embodiment of the present invention, the sleeve 31 is approximately 30 inches in length and the mounting pole extends upwardly from the grade level G a height of approximately 12 feet. The sunshield 10 has a length along straight edge 10B of 15 feet and a maximum distance between straight edge 10B and arcuate edge 10A of 7½ feet.

Figure 3:
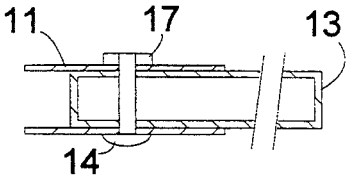
FIG. 3 is a sectional view along line 3—3 in Fig. 2.
Figure 2:
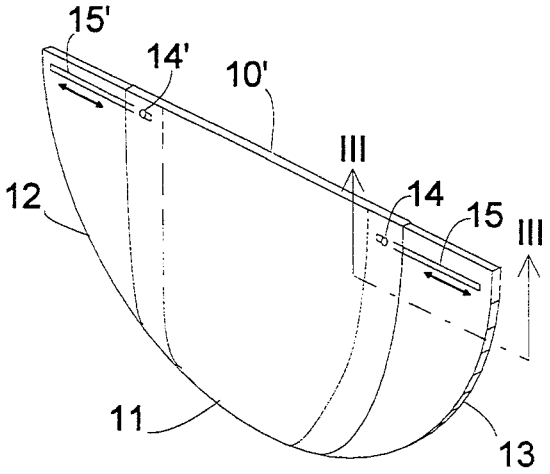
FIG. 2 is an alternative embodiment of the sunshield shown in FIG. 1.

In an alternative embodiment of the present invention, as shown in FIGS. 2 and 3, the sunshield 10' has an adjustable width which is achieved by providing a hollow main central body 11 and two side members 12 and 13 which are slidably received within the main body 11. The side member 13 includes a slot 15 extending therein and the side member 12 has a slot 15' therein. A bolt 14 extends through a throughbore in the main body 11 and through slot 15 and terminates at a tightening nut 16. Similarly, a bolt 14' and a corresponding tightening nut is provided for slot 15' and side member 12.

Once a desired position for the side members 12 and 13 is selected by moving the side members towards and away from each other, the tightening nuts are tightened and the side members are fixed in place. In this manner, the main body 11, which is preferably 11 feet wide and the side members, which are preferably 2 feet wide, can vary the width from 11 to 15 feet.

Figure 4:
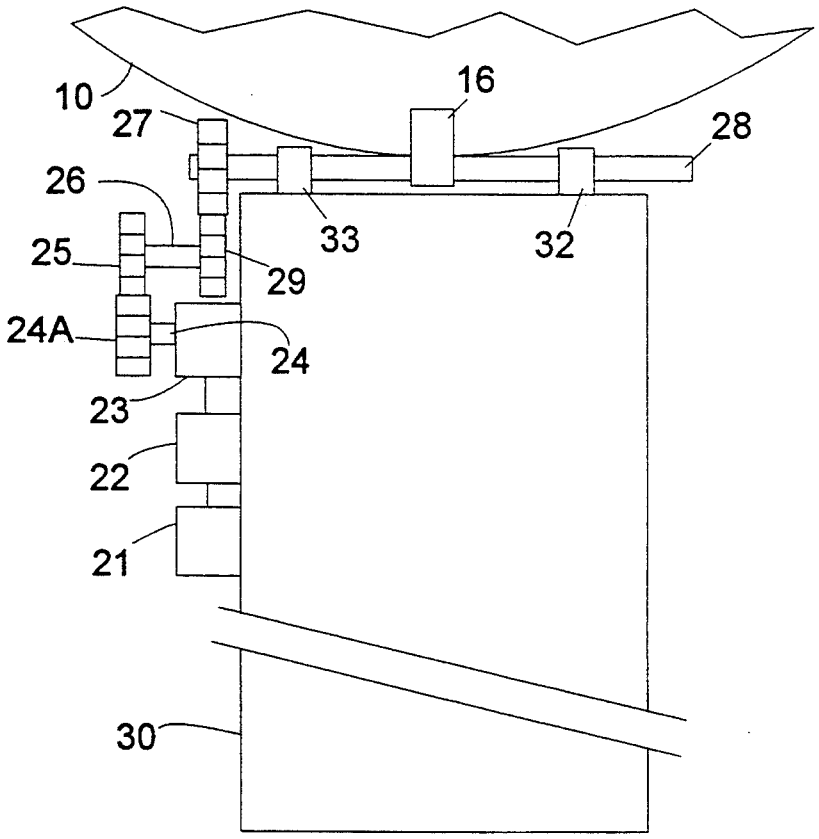
FIG. 4 shows the drive assembly for the sunshield of FIG. 1.

FIG. 4 shows the means 20 for pivotally mounting the sunshield to the support and the means for moving the sunshield between desired angular positions.

Shaft 28 is pivotally mounted in bosses 32 and 33 and sunshield 10 is fixedly mounted on shaft 28 by member 16 so that sunshield 10 pivots with shaft 28 when it rotates.

Also connected to shaft 28 is gear wheel 27 which is mounted for rotation with shaft 28.

In order to rotate the semicircular sunshield 10, a motor 23 is provided which has a power shaft 24 having a gear 24A fixed thereto. An intermediate transmission section comprises shaft 26 having gear 25 fixed thereto and in engagement with gear 24A and gear 29 fixed to shaft 26 and in engagement with gear 27. As a result of the connection, the rotation of power shaft 24 effects the pivoting of the sunshield 10.

Motor 23 is a stepping motor which is periodically energized by a timer 22 connected to a battery 21 and which provides pulsed power to the motor 23 based upon the expected positions of the sun over the course of a day.

The speed and incremental movement of the sunshade relative to the movement of the shaft 24 of motor 23 can be controlled by the timer or by the gear ratio of the gears 25 and 29 on shaft 26.

The motor 24 can also be energized by power from an AC source which is passed through a transformer prior to being fed to the timer 22.

Figure 5:
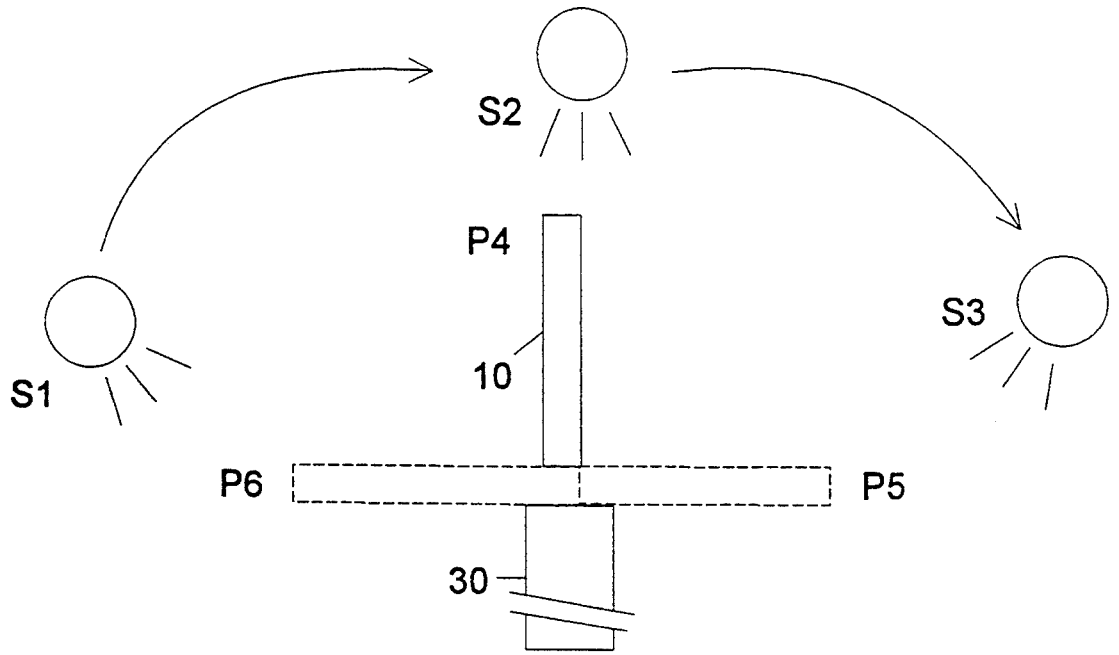
FIG. 5 is a schematic representation showing the positions of the sunshield for different positions of the sun.

In a preferred embodiment of the present invention as shown in FIG. 5, the sunshade starts in position P4 in the morning with the sun in the position of S1 at dawn. Gradually as the sun moves from position S1 to S2 at noon, sunshade 10 moves from position P4 to P5. As the sun moves from position S2 to S3 at dusk, the sunshade is first moved from the position P5 to the position P4 in one hour and then from P4 to P6 in the time remaining until dusk.

Figure 5A:
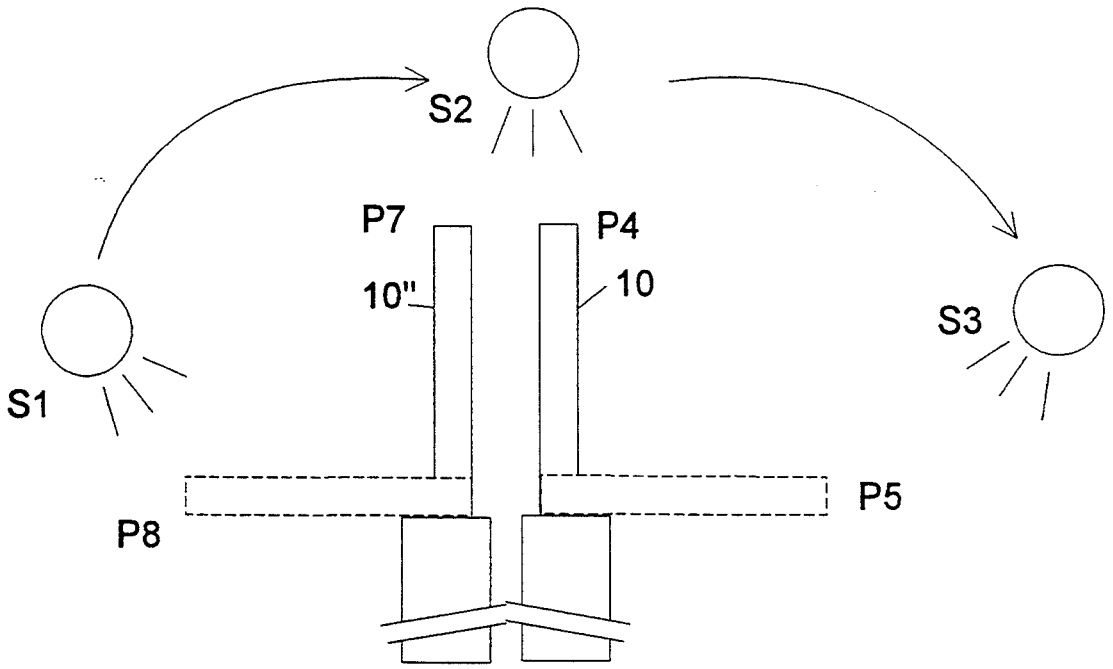
FIG. 5A is an alternative schematic representation of the operation of the present invention.

In order to eliminate the need for the relatively fast movement from P5 to P4 in the hour after noon, an alternative embodiment is shown in FIG. 5A where two sunshades are used. As shown, when the sun is at S1, sunshields 10 and 10" are at positions P4 and P7 respectively. As the sun's position changes from S1 to S2, sunshield 10 moves to position P5 while sunshield 10" remains at P7. As the position of the sun changes from S2 to S3, sunshield 10" moves from P7 to PS, while sunshield 10 remains at P5. The two sunshields are returned to positions P4 and P7 after dusk.

Figure 6:
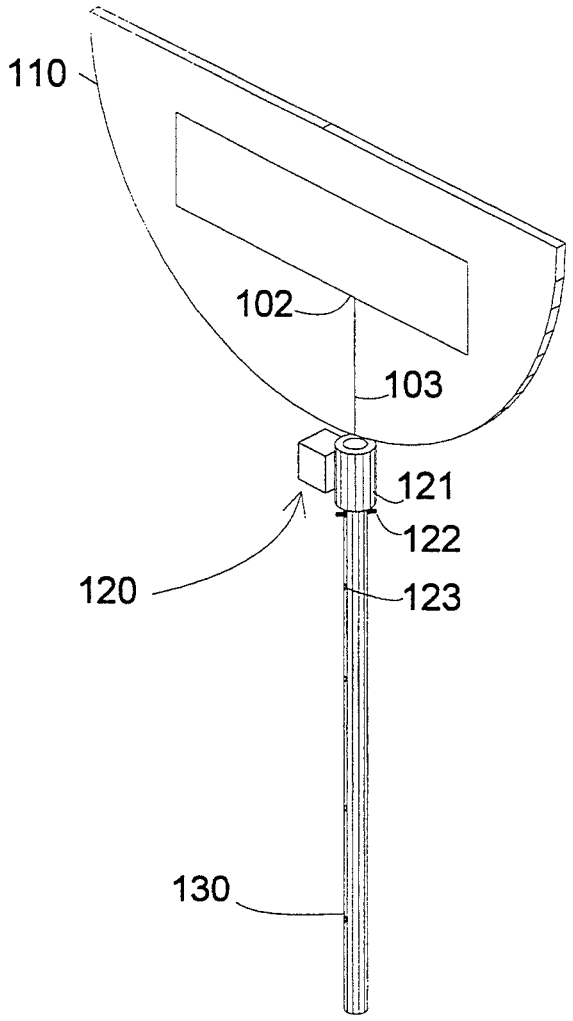
FIG. 6 is an alternative embodiment of the sunshade according to the invention.

FIG. 6 shows a further embodiment of the present invention wherein the transmission 120 is similar to that shown in FIG. 4 with the exception that instead of a battery 21, a sheet of photovoltaic cells 102 is disposed on the sunshield 110 on one or both surfaces thereof and is connected via a conductor 103 to the timer 22. In this embodiment, the sun that is being shielded is also used to energize the motor.

In this embodiment, the sunshield 110 is pivotally mounted to pole 130 via a sleeve 121 is slidably mounted around the pole 130 and which is releasably retained in position by pin 122 extending through throughbores 123 disposed all along the pole 130. The pivotal mounting of the sunshade 110 to sleeve 121 is carried out by elements 16, 32, 33 and 28 as in FIG. 4, with the exception that the elements 32 and 33 are mounted on the top of the sleeve 121 rather than on the top of the pole. This embodiment also differs from that of FIG. 4 in that the transmission 120 is mounted on the sleeve 121, rather than on the pole.

As a result of the mounting shown in FIG. 6, the sunshield moves in the same way as in the earlier embodiments, however, when in the position shown in FIG. 6, the sunshield can be lowered to the ground in the event that high winds are expected or that the user merely wants to remove the device from use. This lowering of the sunshield is carried out by merely removing pin 122 from the throughbore 123 that it is currently in and allowing the sleeve 121 along with the transmission 120 and sunshield 110 to slide downwardly along pole 130. The user has the option of maintaining the assembly at any desired lower position by inserting the pin 122 into any one of the holes 123. If it is desired to maintain the assembly in the lowest position, then sleeve 121 is allowed to rest on the ground.

Figure 7:
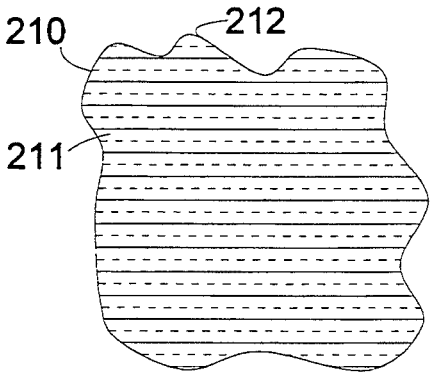
FIG. 7 is a further embodiment of the sunshield.

FIG. 7 shows a further embodiment for the sunshield 210 to avoid the effects of wind. The sunshield 210 has two spaced apart main surfaces as shown in FIG. 3 with spaced apart longitudinal slots 211 in one surface and spaced apart longitudinal slots 212 in the other surface. The slots are offset from each other by preferably half the width of the slots so that while air can pass through the sunshield, little or no light will pass through. In a preferred embodiment, the slots are one half inch wide and offset by a quarter of an inch. The sunshield is preferably made of a light-weight rigid material such as fiberglass or aluminum.

It is understood that the embodiments described hereinabove are merely illustrative and are not intended to limit the scope of the invention. It is realized that various changes, alterations, rearrangements and modifications can be made by those skilled in the art without substantially departing from the spirit and scope of the present invention.

What is claimed is:

1. A sunshade for providing protection from the sun comprising: an upright support member; a sunshield comprising a semicircular member having an arcuate edge and a straight edge and wherein the semicircular member comprises a hollow body and two side members slidably received in the hollow body for movement toward and away from each other to adjust the width thereof; means pivotally mounting the sunshield to the support member for movement between a first angular position and a second angular position; and energizable means for incrementally moving the sunshield between the first and second angular positions to dispose the sunshield in a desired position relative to the position of the sun.

2. The sunshade according to claim 1, wherein the means mounting the sunshield comprises means pivotally connecting the semicircular member at the arcuate edge to the support member.

3. The sunshade according to claim 2, wherein the means for pivotally connecting the semicircular member to the support member comprises a hinge.

4. The sunshade according to claim 1, wherein the means for moving the sunshield comprises a step motor having a rotatable power shaft and a transmission connecting the shaft to the sunshield to pivot same in response to the rotation of the shaft.

5. The sunshade according to claim 4, wherein the means for moving the sunshield further comprises a timer for periodically energizing the motor to effect a gradual movement of the sunshield between the first and second positions in accordance with the position of the sun.

6. The sunshade according to claim 5, wherein the means for moving comprises a battery for energizing the motor.

7. The sunshield according to claim 5, wherein the means for moving comprises photovoltaic cells for energizing the motor and wherein the cells are mounted on surfaces of the sunshield.

8. The sunshade according to claim 1, wherein the support member comprises a pole.

9. The sunshade according to claim 8, wherein the mean pivotally mounting the sunshield comprises a sleeve disposed around the pole for sliding movement therealong, means pivotally mounting the sunshield to the sleeve and means for releasably retaining the sleeve at a top portion of the pole.

10. The sunshade according to claim 1, wherein the sunshield has means for adjusting a width thereof.

11. The sunshade according to claim 1, wherein the sunshield has two parallel spaced apart main surfaces each with parallel elongated slots and wherein the slots of one main surface are offset with respect to those of the other main surface.

12. A method for providing protection from the sun comprising the steps of: pivotally mounting a sunshield to a support member for movement between a first angular position and a second angular position; incrementally moving the sunshield between the first and second angular positions to dispose the sunshield in a desired position relative to the position of the sun; and adjusting a width of the sunshield by providing a hollow body and two side members slidably received in the hollow body for the sunshield and moving the side members toward and away from each other to adjust the width of the sunshield.

13. The method according to claim 12, wherein the sunshield comprises a semicircular member having an arcuate edge and a straight edge and wherein the step of mounting the sunshield comprises pivotally connecting the semicircular member at the arcuate edge to the support member.

14. The method according to claim 12, wherein the step of moving the sunshield comprises stepping a rotatable power shaft connected to the sunshield to pivot same in response to the rotation of the shaft.

15. The method according to claim 14, wherein the step of stepping comprises periodically energizing a motor to effect a gradual movement of the sunshield between the first and second positions in accordance with the position of the sun.

16. The method according to claim 15, wherein the step of energizing comprises energizing the motor with a battery.

17. A sunshade for providing protection from the sun comprising: an upright support member; a sunshield comprises a hollow body and two side members slidably received in the hollow body for movement toward and away from each other to adjust a width thereof; said sunshield further having two parallel spaced apart main surfaces each with parallel elongated slots and wherein the slots of one main surface are of offset with respect to those of the other main surface; means pivotally mounting the sunshield to the support member for movement between a first angular position and a second angular position; and energizable means for incrementally moving the sunshield between the first and second angular positions to dispose the sunshield in a desired position relative to the position of the sun.

18. The sunshade according to claim 17, wherein the sunshield comprises a semicircular member having an arcuate edge and a straight edge.

19. The sunshade according to claim 18, wherein the means mounting the sunshield comprises means pivotally connecting the semicircular member at the arcuate edge to the support member.

20. The sunshade according to claim 19, wherein the means for pivotally connecting the semicircular member to the support member comprises a hinge.

21. The sunshade according to claim 17, wherein the means for moving the sunshield comprises a step motor having a rotatable power shaft and a transmission connecting the shaft to the sunshield to pivot same in response to the rotation of the shaft.

22. The sunshade according to claim 21, wherein the means for moving the sunshield further comprises a timer for periodically energizing the motor to effect a gradual movement of the sunshield between the first and second positions in accordance with the position of the sun.

23. The sunshade according to claim 22, wherein the means for moving comprises a battery for energizing the motor.

24. The sunshield according to claim 22, wherein the means for moving comprises photovoltaic cells for energizing the motor and wherein the cells are mounted on surfaces of the sunshield.

25. The sunshade according to claim 17, wherein the support member comprises a pole.

26. The sunshade according to claim 25, wherein the mean pivotally mounting the sunshield comprises a sleeve disposed around the pole for sliding movement therealong, means pivotally mounting the sunshield to the sleeve and means for releasably retaining the sleeve at a top portion of the pole.

* * * * *